US008851923B2

(12) United States Patent
Klaassen et al.

(10) Patent No.: US 8,851,923 B2
(45) Date of Patent: Oct. 7, 2014

(54) HERMETICALLY SEALED TERMINAL PINS WITH HOLES FOR CONNECTING TO WIRES

(75) Inventors: Hendrik Hermanus Klaassen, Wierden (NL); Albertus Jan Hendrik Kolkman, Dalen (NL); Franz Dieter Paterek, Vroomshoop (NL)

(73) Assignee: Emerson Electric Co., St. Louis, MO (US)

( * ) Notice: Subject to any disclaimer, the term of this patent is extended or adjusted under 35 U.S.C. 154(b) by 42 days.

(21) Appl. No.: 13/569,499

(22) Filed: Aug. 8, 2012

(65) Prior Publication Data

US 2014/0045369 A1 Feb. 13, 2014

(51) Int. Cl.
*H01R 13/40* (2006.01)

(52) U.S. Cl.
USPC ..... 439/587

(58) Field of Classification Search
USPC ..... 439/519, 587, 247, 274, 287
See application file for complete search history.

(56) References Cited

U.S. PATENT DOCUMENTS

| | | | | |
|---|---|---|---|---|
| 3,340,347 | A | 9/1967 | Spiegler | |
| 3,662,082 | A * | 5/1972 | Heppner | 174/18 |
| 3,792,416 | A * | 2/1974 | Moulin | 439/274 |
| 4,964,788 | A | 10/1990 | Itameri-Kinter et al. | |
| 5,888,088 | A * | 3/1999 | Kobayashi et al. | 439/404 |
| 7,241,185 | B1 * | 7/2007 | Cecil et al. | 439/730 |
| 7,294,008 | B2 * | 11/2007 | Fukuyama | 439/287 |
| 7,597,596 | B2 * | 10/2009 | Watanabe | 439/877 |
| 7,878,548 | B2 * | 2/2011 | Kohama | 280/806 |
| 7,896,712 | B2 * | 3/2011 | Cecil et al. | 439/730 |
| 8,246,390 | B2 * | 8/2012 | Cecil et al. | 439/730 |
| 2001/0009823 | A1 * | 7/2001 | Suzuki | 439/587 |
| 2003/0139092 | A1 | 7/2003 | Wu | |
| 2011/0237104 | A1 | 9/2011 | Biesse et al. | |
| 2011/0270067 | A1 | 11/2011 | Faraji et al. | |
| 2012/0184122 | A1 * | 7/2012 | Stokowski et al. | 439/247 |

OTHER PUBLICATIONS

International Search Report and Written Opinion for PCT/US2013/050281, mailed Dec. 23, 2013; ISA/US.

Crimp Ring Connectors. Online Catalog. Altex. Jun. 22, 2010 [retrieved Dec. 10, 2013]. http://web.archive.org/web/20100622015455/http://www.altex.com/Crimp-Ring-Connectors-C10648.aspx. pp. 1-2.

* cited by examiner

*Primary Examiner* — Chandrika Prasad
(74) *Attorney, Agent, or Firm* — Harness, Dickey & Pierce, P.L.C.

(57) ABSTRACT

A hermetic terminal assembly includes a terminal body and terminal pins extending through the terminal body. The terminal pins each have a first end configured for connection to a power source disposed outside of a hermetic compressor and a second end configured for direct connection to motor windings disposed within hermetic compressor.

19 Claims, 8 Drawing Sheets

HERMETICALLY SEALED TERMINAL PINS WITH HOLES FOR CONNECTING TO WIRES

FIELD

The present disclosure relates to hermetic terminals, and more specifically to hermetic terminals with a fully insulated direct wire connection.

BACKGROUND

This section provides background information related to the present disclosure which is not necessarily prior art.

Hermetic terminal assemblies carry electric current from an external power source to motor windings in a hermetic compressor while ensuring that the interior of the hermetic compressor is hermetically sealed. Hermetic terminal installations can include a terminal including one or more terminal pins and a clusterblock. The terminal can be hermetically sealed to a compressor housing. The terminal pins extend through the terminal and are hermetically sealed thereto. A first end of the terminal pins can be connected to wires routed to an external power source and a second end of the terminal pins can be connected to wires routed to motor windings in a hermetic compressor.

The second ends of the terminal pins are typically connected to the wires routed to the motor windings via wire connectors. The clusterblock secures the wire connectors to the terminal pins to establish and maintain electrical connections between the wires and the terminal pins. The clusterblock can insulate the electrical connection between the wires and the terminal pins.

SUMMARY

This section provides a general summary of the disclosure, and is not a comprehensive disclosure of its full scope or all of its features.

A hermetic terminal assembly according to the principles of the present disclosure includes a terminal body, a plurality of terminal pins extending through the terminal body, and a plurality of glass-to-metal seals disposed between the terminal pins and the terminal body to yield a hermetic seal between the terminal body and the terminal pins. A first side of the terminal body is configured to be disposed outside of a hermetic compressor. A second side of the terminal body is configured to be disposed within the hermetic compressor. An outer surface of the terminal body is configured to be hermetically sealed to a housing of the hermetic compressor. The terminal pins each have a first end for connection to a power source disposed outside of the hermetic compressor and a second end disposed on the second side of the terminal body for connection to motor windings disposed within the hermetic compressor.

In one example, each of the terminal pins comprises a blind hole extending axially into the second ends of the terminal pins. The blind holes are configured to receive a plurality of wires for connection to the motor windings. In another example, each of the terminal pins comprises a through hole located adjacent to the second end and extending perpendicular to a longitudinal axis thereof. The through holes are configured to receive a plurality of wires for connection to the motor windings.

An alternative embodiment of a hermetic terminal assembly according to the principles of the present disclosure includes a terminal body, a plurality of current-conducting tubes extending through the terminal body, and a plurality of glass-to-metal seals disposed between the tubes and the terminal body to hermetically seal the tubes to the terminal body. Each of the tubes has a first end disposed on the first side of the terminal body and a second end disposed on the second side of the terminal body. The tubes are configured to receive a plurality of wires for connecting a power source disposed outside of the hermetic compressor to motor windings disposed within the hermetic compressor.

In one example, each of the tubes comprises a through hole that extends axially therethrough for receiving the wires. In another example, each of the tubes comprises a first blind hole that extends axially into the first end thereof and a second blind hole that extends axially into the second end thereof. The first blind holes are configured to receive a first plurality of wires connected to the power source. The second blind holes are configured to receive a second plurality of wires connected to the motor windings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
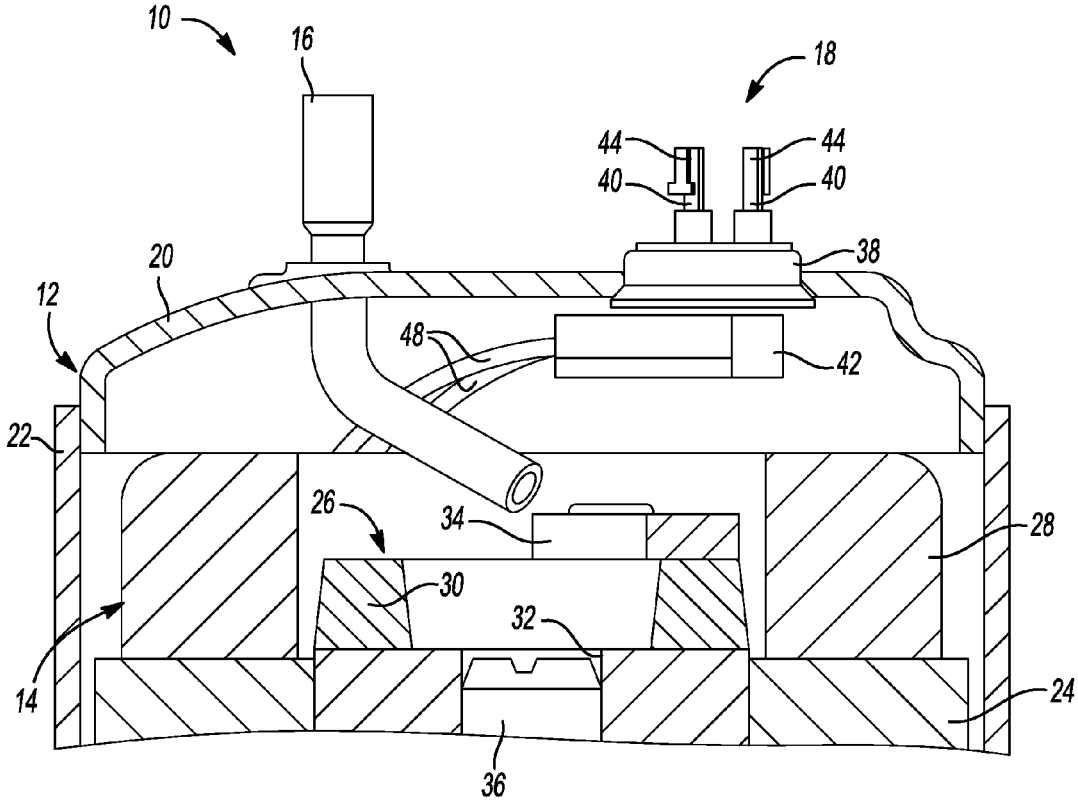
Fig-1 PRIOR ART
FIG. 1 is a partial sectional view of a hermetic compressor according to the prior art, the hermetic compressor including a hermetic terminal assembly and clusterblock.
Figure 2:
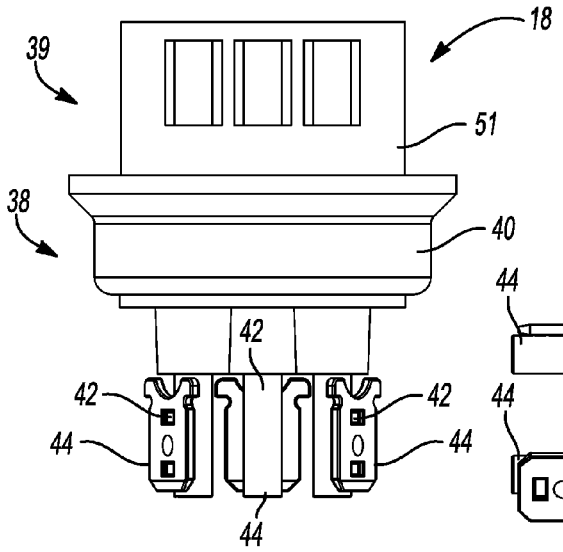
Fig-2 PRIOR ART
FIG. 2 is a top view of the hermetic terminal assembly and clusterblock of FIG. 1.
Figure 3:
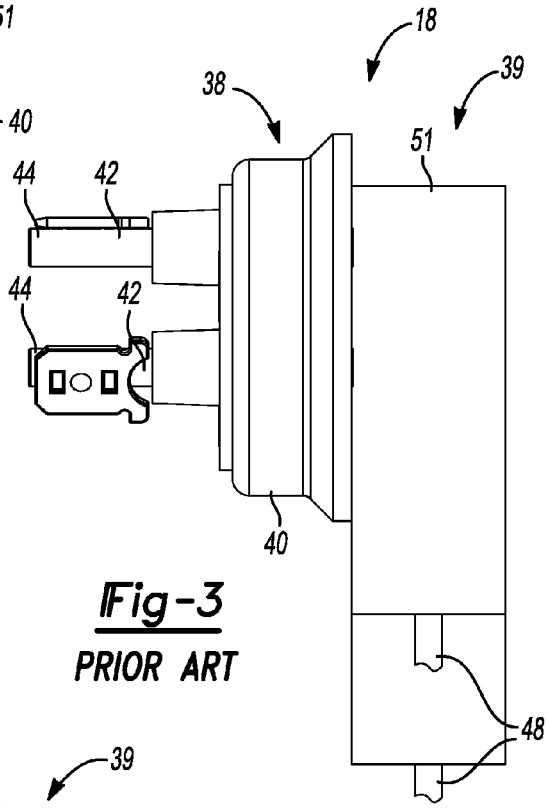
Fig-3 PRIOR ART
FIG. 3 is a side view of the hermetic terminal assembly and clusterblock of FIG. 1.
Figure 4:
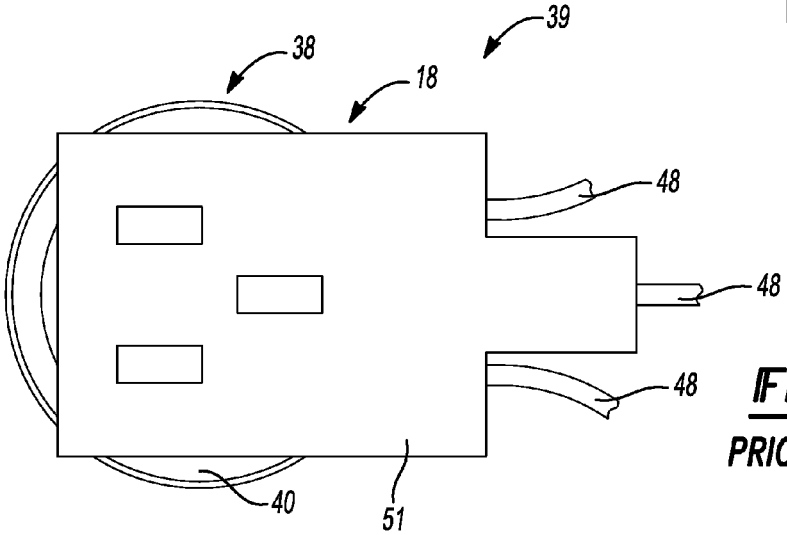
Fig-4 PRIOR ART
FIG. 4 is a front view of the hermetic terminal assembly and clusterblock of FIG. 1.

Example embodiments will now be described more fully with reference to the accompanying drawings. Referring now to FIG. 1, an exemplary hermetic compressor 10 includes a housing 12, a motor 14, a discharge tube 16, and a hermetic terminal installation 18. The housing 12 includes an upper portion 20 and a lower portion 22. The upper portion 20 and the lower portion 22 are hermetically sealed together by, for example, brazing or welding. The motor 14 is disposed within the housing 12. The terminal installation 18 can be mounted to the upper portion 20 (e.g., to the top of the compressor 10) as shown, or the terminal installation 18 can be mounted to the lower portion 22 (e.g., to the side of the compressor 10).

The motor 14 includes a stator 24 and a rotor 26. The stator 24 has windings 28 and is secured to the housing 12 via an interference fit. The rotor 26 has an end cap 30 and a central aperture 32. A counterweight 34 is attached to the end cap 30 and a crankshaft 36 is secured in the central aperture 32 via an interference fit. The crankshaft 36 is drivingly coupled to a compression mechanism (not shown) of the type included in, for example, a scroll compressor, a rotary screw compressor, or a reciprocating compressor.

The motor 14 rotates the crankshaft 36 to drive the compression mechanism. In turn, the compression mechanism compresses refrigerant, and compressed refrigerant is discharged into the interior of the housing 12. Compressed refrigerant in the interior of the housing 12 is then discharged through the discharge tube 16. The discharge tube 16 extends through the upper portion 20 of the housing 12 and is hermetically sealed to the housing 12 by, for example, soldering.

The terminal installation 18 carries electrical current from a power source (not shown) external to the compressor 10 to the motor 14 inside the compressor housing 12. With additional reference to FIGS. 2 through 6, the terminal installation 18 includes a terminal assembly 38 and a clusterblock assembly 39. The terminal assembly 38 includes a terminal plate or body 40 and terminal pins 42 extending through the terminal body 40. The terminal body 40 is hermetically sealed to the housing 12 by, for example, brazing or welding. The pins 42 are hermetically sealed to the terminal body 40 by, for example, a glass-to-metal seal.

Figure 5:
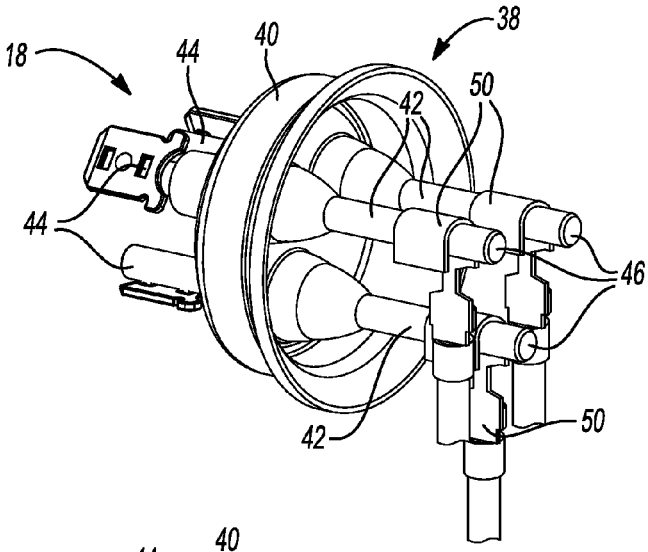
Fig-5 PRIOR ART
FIG. 5 is a perspective view of the hermetic terminal assembly of FIG. 1 with the body portion of the clusterblock removed to illustrate electrical connections between the hermetic terminal and wires routed to motor windings.
Figure 6:
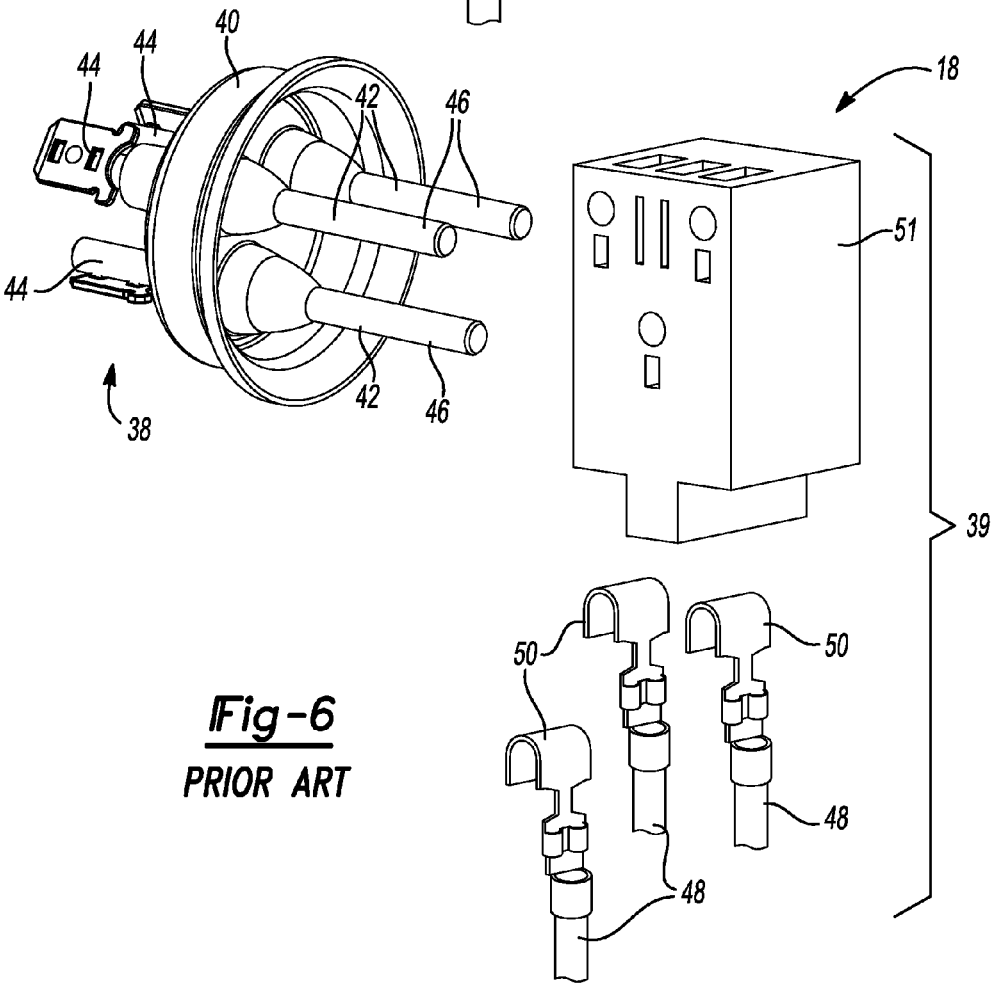
Fig-6 PRIOR ART
FIG. 6 is a perspective view of the hermetic terminal assembly and clusterblock of FIG. 1 with the clusterblock exploded.

The pins 42 each have a first end 44 and a second end 46. The first end 44 of the pins 42 can be electrically connected to wires (not shown) routed to the power source. The terminal assembly 38 can include these wires. The second end 46 of the pins 42 is electrically connected to wires 48 via wire connectors 50 (FIGS. 5 and 6). The wires 48 are routed to the windings 28 of the motor 14. The clusterblock assembly 39 includes the wires 48, the wire connectors 50, and a clusterblock body 51 that secures the wire connectors 50 to the pins 42 to establish and maintain the electrical connections therebetween. The clusterblock body 51 can be formed from a plastic dielectric and can electrically insulate the connections between the pins 42 and the wire connectors 50. The wire connectors 50 can be embedded in the clusterblock body 51 (e.g., using a press fit), and then the clusterblock body 51 can be slid over the pins 42.

In certain compressor applications, media inside the compressor 10, such as a combination of Polyalkylene Glycol (PAG) oil and R134A refrigerant, are slightly conductive. In addition, metal components in the terminal installation 18 can be exposed to this conductive media. As a result, the insulation resistance between the pins 42, between the pins 42 and adjacent electrically-connected components, between the pins 42 and the terminal body 40, and/or between the pins 42 and the housing 12 can be significantly reduced. This creates electrical losses and can possibly cause the housing 12 to be electrically charged if the housing 12 is not grounded.

Conductive media that may be present within a hermetic compressor is not limited to the combination of PAG oil and R134A refrigerant, and may include various refrigerants used in automotive applications. The issue of conductive media shorting terminal pins within a hermetic compressor to each other and nearby components may be exacerbated by the position of the terminal pins. For example, certain compressor applications may require that the terminal pins are closer together and oriented in a straight line rather than in a circle.

Figure 7:
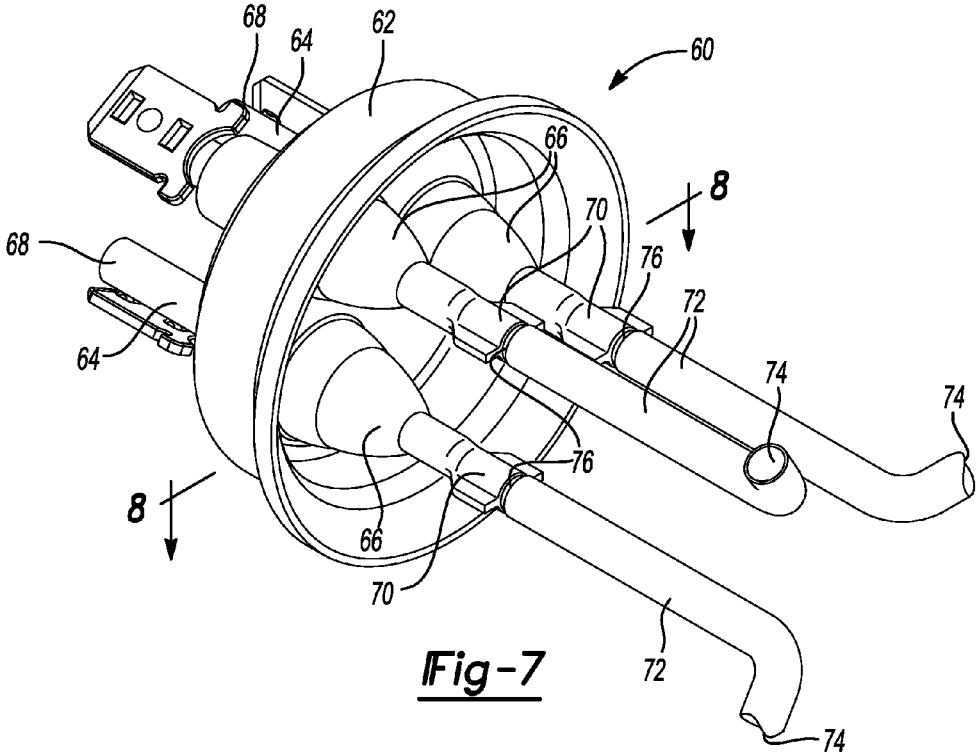
FIG. 7 is a perspective view of a hermetic terminal installation according to the principles of the present disclosure, the hermetic terminal installation including a hermetic terminal assembly.
Figure 8:
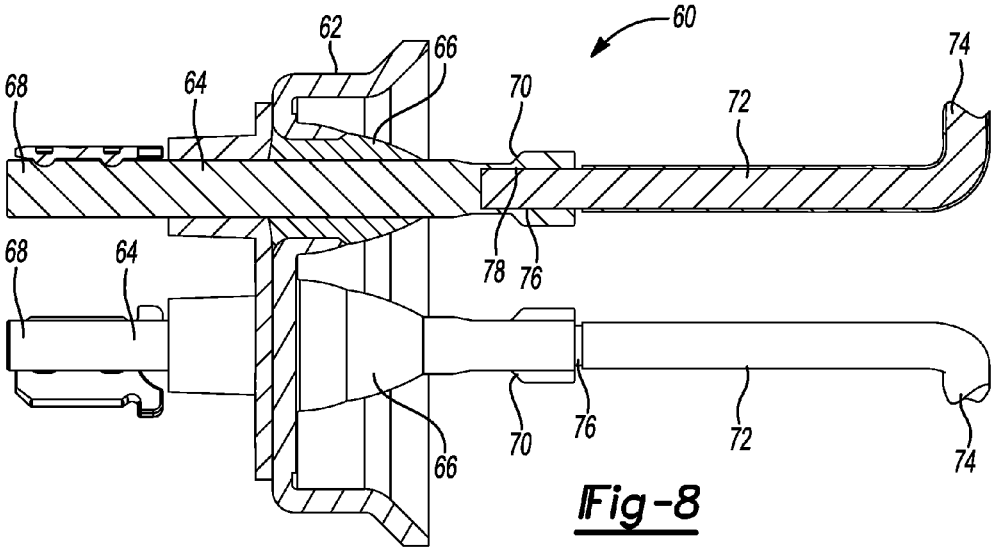
FIG. 8 is a cross-sectional view of the hermetic terminal installation of FIG. 7 taken along a line 8-8 shown in FIG. 7.

Referring now to FIGS. 7 and 8, a hermetic terminal assembly 60 includes a terminal body 62 and terminal pins 64 extending through the terminal body 62. The terminal body 62 and the pins 64 can be formed from metal (e.g., steel). The interface between the terminal body 62 and the pins 64 can be hermetically sealed by glass-to-metal seals 66.

A first end 68 of the pins 64 can be electrically connected to wires (not shown) routed to a power source. A second end 70 of the pins 64 is electrically connected to wires 72 that can be routed to motor windings within a compressor. The wires 72 can be formed from metal (e.g., copper, nickel).

The wires 72 can be electrically insulated using insulation 74, and the insulation 74 can be stripped from an end 76 of the wires 72. A concentric blind hole 78 can be formed (e.g., machined) into the second end 70 of the pins 64 and the end 76 of the wires 72 can be inserted into the blind hole 78. The second end 70 of the pins 64 can then be deformed (e.g., crimped) to yield direct electrical connections between the pins 64 and the wires 72. The blind hole 78 can be machined into the second end 70 of the pins 64 before the pins 64 are installed in the terminal assembly 60 to avoid metal debris penetrating the glass-to-metal seals 66 and causing cracks therein.

Figure 9:
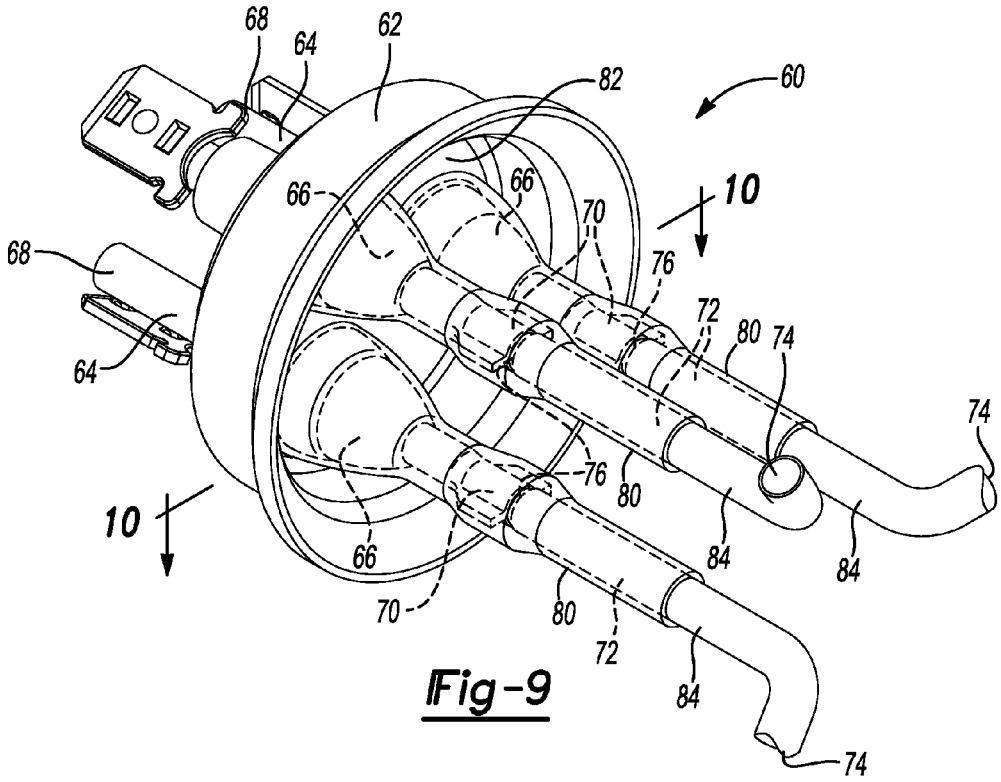
FIG. 9 is a perspective view of the hermetic terminal installation of FIG. 7 with heat shrink tubing insulating electrical connections between pins of the hermetic terminal assembly and wires routed to motor windings.
Figure 10:
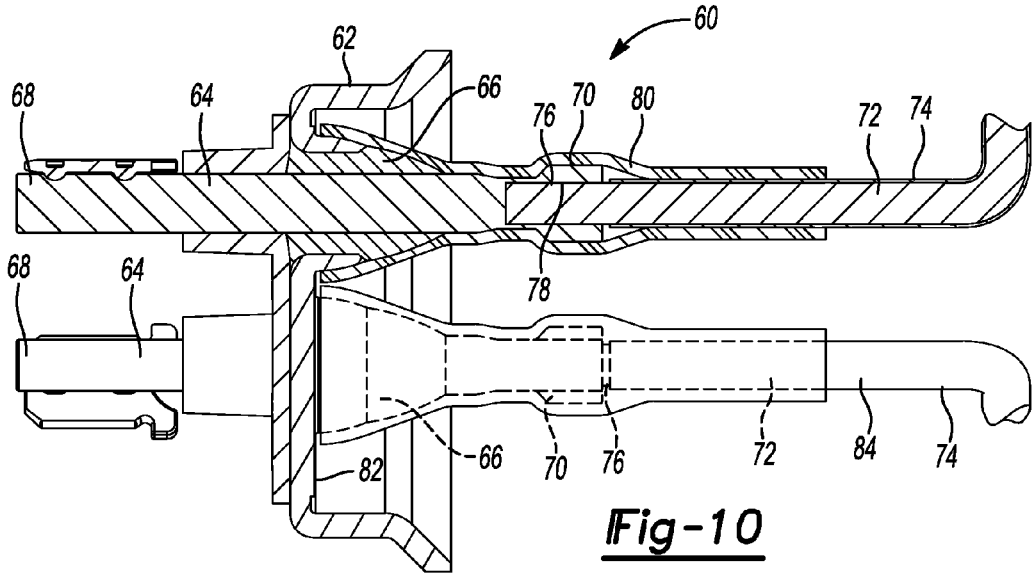
FIG. 10 is a cross-sectional front view of the hermetic terminal installation of FIG. 9 taken along a line 10-10 shown in FIG. 9.

With additional reference to FIGS. 9 and 10, heat shrink tubing 80 can be placed around the pins 64 and the wires 72 to insulate the direct connections between the pins 64 and the wires 72. The tubing 80 can be slid onto the wires 72 before the wires 72 are inserted into the pins 64 and then slid onto the pins 64 as the wires 72 are inserted into the pins 64. Heat can then be applied to the tubing 80 to seal the interface between the wires 72 and the tubing 80. The tubing 80 can extend from an inner surface 82 of the terminal body 62 to a segment 84 of the wires 72 that is insulated by the insulation 74.

The tubing 80 prevents contact between conductive media within a compressor and otherwise exposed portions of current-carrying components of the terminal assembly 60, including the pins 64, and the wires 72. The tubing 80 can be formed from a material that is compatible with one or more refrigerants. The tubing 80 may include an adhesive layer applied to an inner surface thereof to improve the seal between the tubing 80 and the wires 72.

Directly connecting the pins 64 to the wires 72 instead of attaching the pins 64 to the wires 72 using wire connectors and/or a clusterblock body reduces the costs of the terminal assembly 60 installation. In addition, eliminating the cluster-block body allows for a compact connection between the pins 64 and the wires 72, which reduces the amount of installed space required for the terminal assembly 60. Insulating the direct connections between the pins 64 and the wires 72 using the tubing 80 prevents low insulation resistance between the pins 64 (and nearby components), even when conductive media surrounds the terminal assembly 60.

Figure 11:
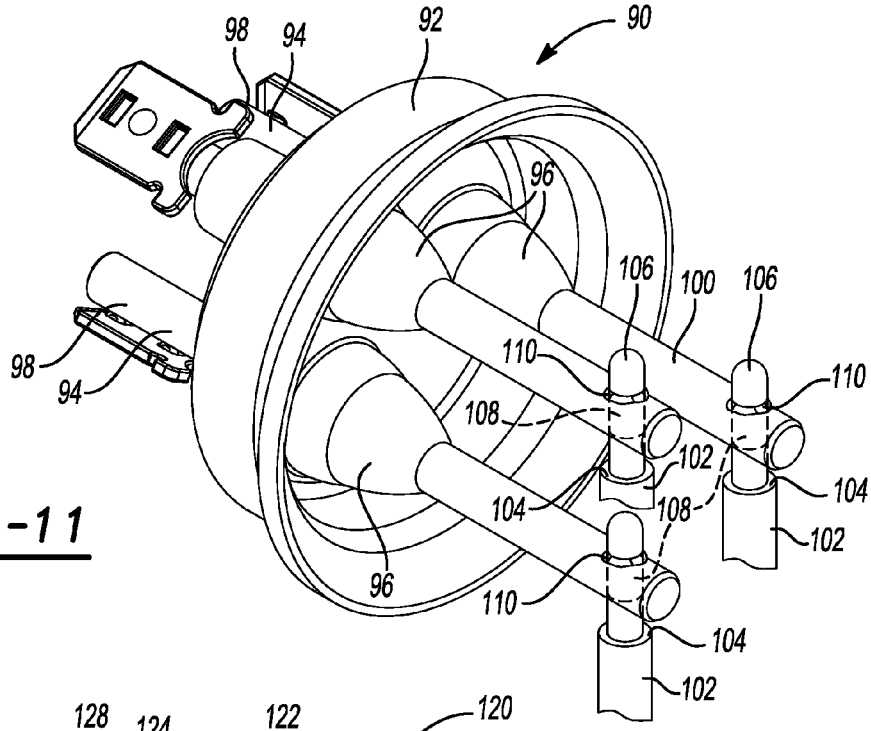
FIG. 11 is a perspective view of an alternative embodiment of a hermetic terminal installation according to the principles of the present disclosure.

Referring now to FIG. 11, a hermetic terminal assembly 90 includes a terminal body 92 and terminal pins 94 extending through the terminal body 92. The terminal body 92 and the pins 94 can be formed from metal (e.g., steel). The interface between the terminal body 92 and the pins 94 can be hermetically sealed by glass-to-metal seals 96.

A first end 98 of the pins 94 can be electrically connected to wires (not shown) routed to a power source. A second end 100 of the pins 94 is electrically connected to wires 102 that can be routed to motor windings within a compressor. The wires 102 can be formed from metal (e.g., copper, nickel).

The wires 102 can be electrically insulated using insulation 104, and the insulation 104 can be stripped from an end 106 of the wires 102. A through hole 108 can be formed (e.g., drilled) into the pins 94 perpendicular to the longitudinal axes of the pins 94. The through hole 108 can be located adjacent to the second end 70 of the pins 64 (e.g., closer to the second end 70 than to a longitudinal midpoint of the pins 64). The stripped end 106 of the wires 102 can be inserted into the through hole 108. The end 106 of the wires 102 can then be joined to the pins 94 by, for example, soldering or brazing, to form a joint 110 and yield direct electrical connections between the pins 94 and the wires 102. Alternatively, solder can be applied to the end 106 of the pins 94 before the end 106 of the pins 94 is inserted into the through hole 108. Example solders that can be used to connected the wires 102 to the pins 94 include ALPHA® OM-5100 62Sn/36Pb/2Ag and ALPHA® OM-338PT Lead free (RoHS compliant).

The joint 110 between the pins 94 and the wires 102 can be formed using high-temperature brazing or low-temperature soldering. High-temperature brazing can be performed before, during, or after the glass-to-metal seals 96 are formed between the terminal body 92 and the pins 94. For low-temperature soldering, the pins 94 can have copper cores and the (solid copper) wires 102 can be soldered directly to the copper cores of the pins 94 to improve adhesion of the joint 110 and decrease the electrical resistance of the joint 110. Insulation, such as heat shrink tubing, can be placed around the joint 110, around the pins 94, and/or around exposed portions of the wires 102.

Figure 12:
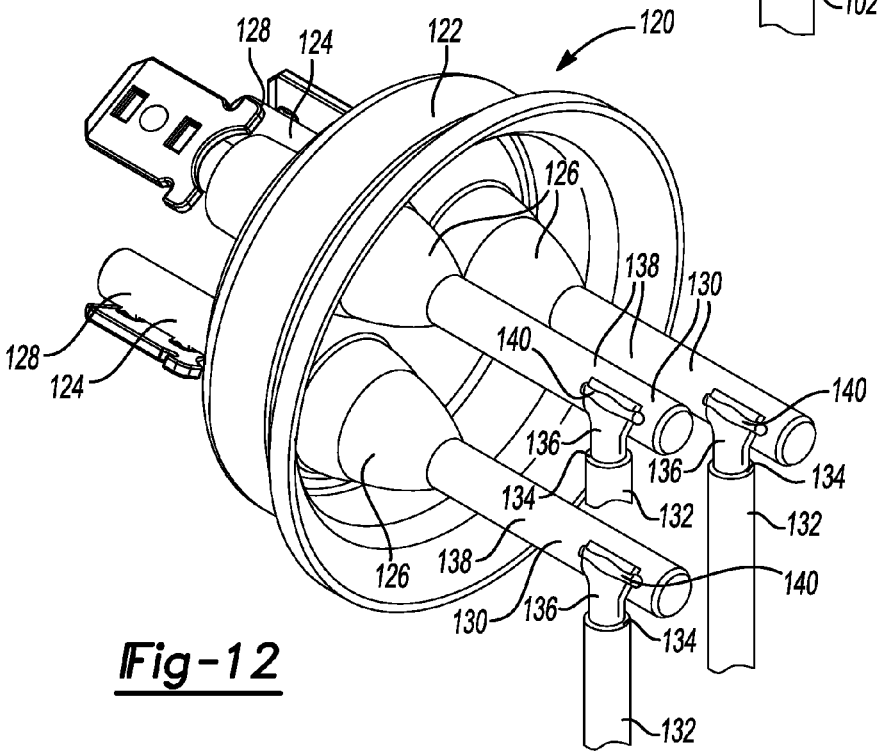
FIG. 12 is a perspective view of another alternative embodiment of a hermetic terminal installation according to the principles of the present disclosure.

Referring now to FIG. 12, a hermetic terminal assembly 120 includes a terminal body 122 and terminal pins 124 extending through the terminal body 122. The terminal body 122 and the pins 124 can be formed from metal (e.g., steel). The interface between the terminal body 122 and the pins 124 can be hermetically sealed by glass-to-metal seals 126.

A first end 128 of the pins 124 can be electrically connected to wires (not shown) routed to a power source. A second end 130 of the pins 124 is electrically connected to wires 132 that can be routed to motor windings within a compressor. The wires 132 can be formed from metal (e.g., copper, nickel).

The wires 132 can be electrically insulated using insulation 134, and the insulation 134 can be stripped from an end 136 of the wires 132. The stripped end 136 of the wires 132 can be joined to an outer surface 138 of the pins 124 by, for example, resistance (e.g., spot) welding to form a joint 140 and yield direct electrical connections between the pins 124 and the wires 132. Insulation, such as heat shrink tubing, can be placed around the joint 140, around the pins 124, and/or around exposed portions of the wires 132.

Figure 13:
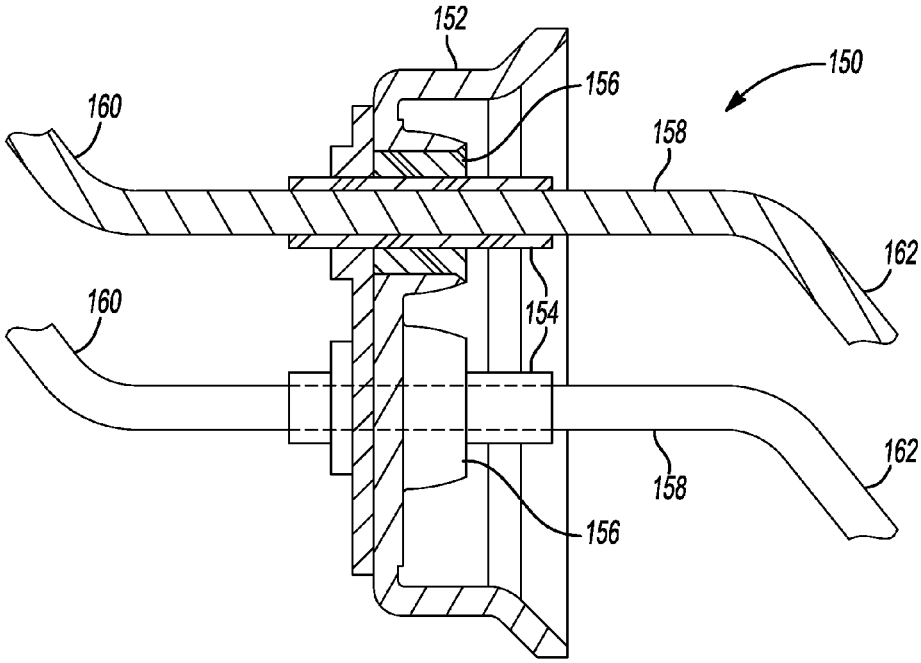
FIG. 13 is a cross-sectional front view of another alternative embodiment of a hermetic terminal installation according to the principles of the present disclosure.

Referring now to FIG. 13, a hermetic terminal assembly 150 includes a terminal body 152 and tubes 154 extending through the terminal body 152. The terminal body 152 and the tubes 154 can be formed from metal (e.g., steel). The interface between the terminal body 152 and the tubes 154 can be hermetically sealed by glass-to-metal seals 156.

Wires 158 extend directly through the tubes 154, and the interface between the tubes 154 and the wires 158 can be hermetically sealed. A first end 160 of the wires 158 can be routed to a power source. A second end 162 of the wires 158 can be electrically connected to motor windings within a compressor. The wires 158 can be formed from metal (e.g., copper, nickel).

The wires 158 can be hermetically connected to the tubes 154 by, for example, brazing, soldering, or welding (e.g., laser welding). The tubes 154 may include (e.g., copper) plating to facilitate laser welding the (e.g., copper) wires 158 to the tubes 154. The wires 158 can be hermetically connected to the tubes 154 by, for example, an adhesive (e.g., epoxy, glue) and/or deforming (e.g., crimping) the tubes 154 after the wires 158 are inserted into the tubes 154.

Figure 14:
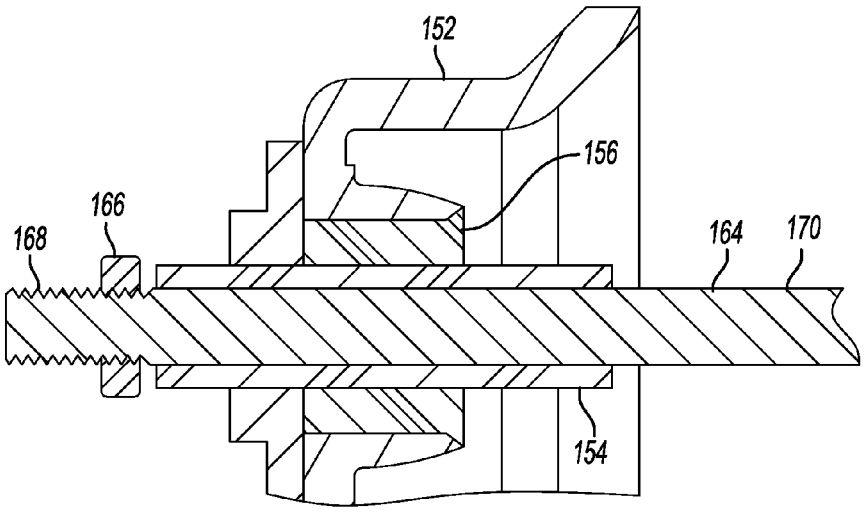
FIG. 14 is a partial cross-sectional front view of still another alternative embodiment of a hermetic terminal installation according to the principles of the present disclosure.

Referring now to FIG. 14, a portion of the terminal assembly 150 is shown with the wires 158 replaced by wires 164. The wires 164 can be inserted through the tubes 154, and a nut 166 can be threaded onto a first end 168 of the wires 164 to prevent the wires 164 from backing out of the tubes 154. External wires (not shown) can be electrically connected to the first end 168 of the wire 164 via a threaded connection and routed to a power source. A second end 170 of the wires 164 can be routed to motor windings within a compressor.

The wires 164 can be formed from metal (e.g., copper, nickel aluminum). The wires 164 can have a copper core with a stainless steel jacket, at least a portion of which can be removed to hermetically connect the wires 164 to the tubes 154. The outer diameter of the wires 164 can be maximized and the thickness of the tubes 154 can be minimized to achieve the threaded connection.

Figure 15:
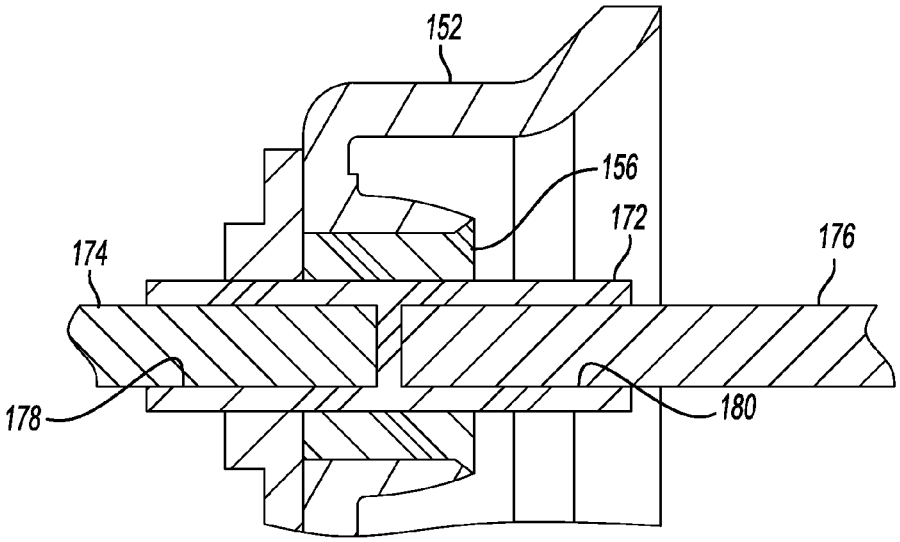
FIG. 15 is a partial cross-sectional front view of a portion of another alternative embodiment of a hermetic terminal installation according to the principles of the present disclosure.

Referring now to FIG. 15, a portion of the terminal assembly 150 is shown with the tubes 154 replaced by tubes 172 and the wires 158 replaced by wires 174, 176. Blind holes 178, 180 can be formed (e.g., machined) into opposite ends of the tubes 172. The wires 174 can be inserted into the blind hole 178 and routed to a power source. The wires 176 can be inserted into the blind hole 180 and routed to motor windings within a compressor.

The tubes 172 can be formed from metal (e.g., steel). A hermetic seal between the wires 174, 176 and the tubes 172 is not required since the blind hole 180 is hermetically sealed from the blind hole 178 by the design of the tubes 172. In addition, the wires 174, 176 can have different diameters (e.g., the wires 174 can have a smaller diameter than the wires 176).

Elements or features of embodiments of the present disclosure are interchangeable. In one example, heat shrink tubing as discussed with reference to FIGS. 9 and 10 can be used to cover exposed portions of the wires and the pins illustrated in FIGS. 11 through 15. In another example, resistance welding as discussed with reference to FIG. 12 can be used to improve the electrical connection between the wires and the pins illustrated in FIGS. 7 through 10 after the pins are crimped onto the wires.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hermetic terminal assembly comprising:

a terminal body having a first side that is configured to be disposed outside of a hermetic compressor, a second side that is configured to be disposed within the hermetic compressor, and an outer surface that is configured to be hermetically sealed to a housing of the hermetic compressor;

a plurality of terminal pins extending through the terminal body, each of the terminal pins having a first end disposed on the first side of the terminal body for connection to a power source disposed outside of the hermetic compressor and a second end disposed on the second side of the terminal body for connection to motor windings disposed within the hermetic compressor, each of the terminal pins comprising a blind hole extending axially and only partially into the second ends of the terminal pins, the blind holes being configured to receive a plurality of wires for connection to the motor windings;

a plurality of glass-to-metal seals disposed between the terminal pins and the terminal body to yield a first hermetic seal between the terminal body and the terminal pins; and a first insulation material disposed around the terminal pins and the wires to insulate the connection between the terminal pins and the wires, wherein the wires are at least partially covered by a second insulation material and the first insulation material extends from the glass-to-metal seals to a segment of the wires that is covered by the second insulation material.

2. The hermetic terminal assembly of claim 1 wherein a portion of the terminal pins surrounding the blind holes is deformed to hold the wires in the blind holes and directly connect the wires to the terminal pins.

3. The hermetic terminal assembly of claim 2 wherein the portion of the terminal pins surrounding the blind holes is crimped.

4. The hermetic terminal assembly of claim 1 wherein the second insulation material is stripped from ends of the wires that are inserted into the blind holes.

5. The hermetic terminal assembly of claim 1 wherein the first insulation material comprises heat shrink tubing.

6. The hermetic terminal assembly of claim 5 wherein an adhesive is applied to an inner surface of the second insulation material to yield a second hermetic seal between the wires and the second insulation material.

7. A hermetic terminal assembly comprising:

a terminal body having a first side that is configured to be disposed outside of a hermetic compressor, a second side that is configured to be disposed within the hermetic compressor, and an outer surface that is configured to be hermetically sealed to a housing of the hermetic compressor; and a plurality of terminal pins extending through the terminal body, each of the terminal pins having a first end disposed on the first side of the terminal body for connection to a power source that is disposed outside of the hermetic compressor and a second end disposed on the second side of the terminal body for connection to motor windings disposed within the hermetic compressor, each of the terminal pins comprising a cylindrical body with a through hole located adjacent to the second end and extending through the cylindrical body and perpendicular to a longitudinal axis thereof, the through holes being configured to receive a plurality of wires for connection to the motor windings.

8. The hermetic terminal assembly of claim 7 wherein the center of each of the through holes is located a first distance from a longitudinal midpoint of a respective one of the terminal pins and a second distance from the second end from the respective one of the terminal pins that is less than the first distance.

9. A hermetic terminal installation comprising:

the hermetic terminal assembly of claim 7; and the wires, wherein the wires are joined to the terminal pins by one of brazing and soldering the wires to the terminal pins.

10. A hermetic terminal installation comprising:

the hermetic terminal assembly of claim 7; and the wires, wherein the wires are joined to the terminal pins by resistance welding the wires to the terminal pins.

11. A hermetic terminal assembly comprising:

a terminal body having a first side that is configured to be disposed outside of a hermetic compressor, a second side that is configured to be disposed within the hermetic compressor, and an outer surface that is configured to be hermetically sealed to a housing of the hermetic compressor;

a plurality of current-conducting tubes extending through the terminal body, each of the tubes having a first end disposed on the first side of the terminal body and a second end disposed on the second side of the terminal body, the tubes being configured to receive a plurality of wires for connecting a power source disposed outside of the hermetic compressor to motor windings disposed within the hermetic compressor, wherein each of the tubes comprises a through hole that extends axially therethrough for receiving the wires; and a plurality of glass-to-metal seals disposed between the tubes and the terminal body to hermetically seal the tubes to the terminal body.

12. A hermetic terminal installation comprising:

the hermetic terminal assembly of claim 11; and the wires.

13. A hermetic terminal installation comprising:

the hermetic terminal assembly of claim 11; and the wires, wherein each of the wires has a threaded end for connection to the power source.

14. The hermetic terminal installation of claim 13 further comprising a plurality of nuts that are each threaded onto one of the threaded ends of the wires to retain the wires in the tubes.

15. The hermetic terminal assembly of claim 11 wherein the wires are hermetically connected to the tubes by one of brazing, soldering, and welding the wires to the tubes.

16. The hermetic terminal assembly of claim 11 wherein the wires are hermetically connected to the tubes using an adhesive.

17. The hermetic terminal assembly of claim 11 wherein the tubes are crimped to hermetically connect the wires to the tubes.

18. A hermetic terminal assembly comprising:

a terminal body having a first side that is configured to be disposed outside of a hermetic compressor, a second side that is configured to be disposed within the hermetic compressor, and an outer surface that is configured to be hermetically sealed to a housing of the hermetic compressor;

a plurality of current-conducting tubes extending through the terminal body, each of the tubes having a first end disposed on the first side of the terminal body and a second end disposed on the second side of the terminal body, the tubes being configured to receive a plurality of wires for connecting a power source disposed outside of the hermetic compressor to motor windings disposed within the hermetic compressor; and a plurality of glass-to-metal seals disposed between the tubes and the terminal body to hermetically seal the tubes to the terminal body, wherein each of the tubes comprises a first blind hole that extends axially and only partially into the first end thereof and a second blind hole that extends axially and only partially into the second end thereof, the first blind holes being configured to receive a first plurality of wires connected to the power source, the second blind holes being configured to receive a second plurality of wires connected to the motor windings.

19. The hermetic terminal assembly of claim 18 wherein the first plurality of wires and the second plurality of wires are hermetically connected to the tubes by one of brazing, soldering, and welding the first plurality of wires and the second plurality of wires to the tubes.

* * * * *